US010772395B2

(12) United States Patent
Hacsi

(10) Patent No.: US 10,772,395 B2
(45) Date of Patent: Sep. 15, 2020

(54) FINGER RING WITH BUILT-IN LAUNCHING APPARATUS AND METHODS OF USING SAME

(71) Applicant: James Scott Hacsi, Pueblo, CO (US)

(72) Inventor: James Scott Hacsi, Pueblo, CO (US)

( * ) Notice: Subject to any disclaimer, the term of this patent is extended or adjusted under 35 U.S.C. 154(b) by 0 days.

(21) Appl. No.: 16/297,500

(22) Filed: Mar. 8, 2019

(65) Prior Publication Data

US 2019/0298010 A1 Oct. 3, 2019

Related U.S. Application Data

(60) Provisional application No. 62/650,541, filed on Mar. 30, 2018.

(51) Int. Cl.

| | |
|---|---|
| ***A63H 33/14*** | (2006.01) |
| ***A63H 1/04*** | (2006.01) |
| ***A44C 9/00*** | (2006.01) |
| ***A63H 27/14*** | (2006.01) |
| ***A63H 29/24*** | (2006.01) |

(52) U.S. Cl.

CPC ..... *A44C 9/0053* (2013.01); *A63H 1/04* (2013.01); *A63H 27/14* (2013.01); *A63H 29/24* (2013.01)

(58) Field of Classification Search

CPC ... A63H 1/00; A63H 1/04; A63H 1/06; A63H 5/00; A63H 33/14; A44C 9/00; A44C 9/0061

USPC ..... 446/256, 259–263, 266, 26–28

See application file for complete search history.

(56) References Cited

U.S. PATENT DOCUMENTS

| | | | | | |
|---|---|---|---|---|---|
| 4,413,443 | A * | 11/1983 | Kulesza | A44C 9/0061 | 446/26 |
| 6,763,681 | B1 * | 7/2004 | Klundt | A44C 9/0061 | 446/236 |
| 7,018,263 | B2 * | 3/2006 | Tiefel | A63H 1/06 | 2/20 |
| 8,096,850 | B1 * | 1/2012 | Heilig | A63H 5/00 | 446/26 |
| 2009/0253345 | A1 * | 10/2009 | Ujita | A63H 1/04 | 446/263 |
| 2010/0159798 | A1 * | 6/2010 | Bertrand | A63H 1/02 | 446/259 |
| 2011/0177750 | A1 * | 7/2011 | Ujita | A63H 1/04 | 446/263 |

* cited by examiner

*Primary Examiner* — Kien T Nguyen

(57) ABSTRACT

A toy ring-launcher apparatus for wearing on a human finger as an item of play jewelry that's comprised of means for starting to rotate and then subsequently releasing other toy apparatuses or objects exhibiting gyroscopic tendencies, such as gyroscopic tops, flying propellers, or rolling wheels so they rotate very fast around a central axis and move independently of the toy ring-launcher apparatus on a flat surface, in the air, or on a toy racing track, respectively. Methods are also included for using the provided toy ring-launcher apparatus to have fun and enjoyment.

6 Claims, 1 Drawing Sheet

FINGER RING WITH BUILT-IN LAUNCHING APPARATUS AND METHODS OF USING SAME

CROSS-REFERENCE TO RELATED APPLICATIONS

Figure 1:
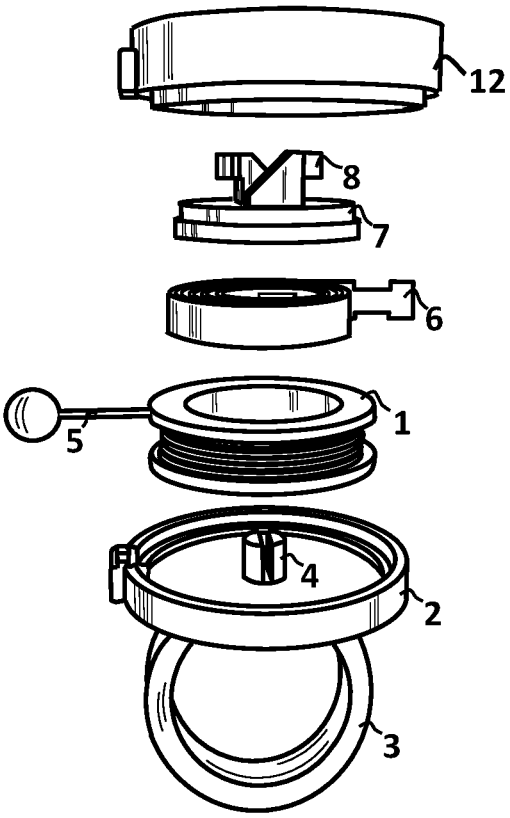

This application claims the benefit of U.S. Provisional Application No. 62/650,541 filed Mar. 30, 2018 by the inventor.

STATEMENT REGARDING SPONSORED RESEARCH

Not applicable

SEQUENCE LISTING OR PROGRAM

Not applicable

BACKGROUND OF THE INVENTION

Field of the Invention

This invention relates generally to toy finger rings for kids to wear, and more specifically, this invention relates to rings worn on a human finger and comprised of means for rotating and then subsequently releasing other toy apparatuses and objects exhibiting gyroscopic tendencies, such as spinning tops, flying propellers, or wheels that roll on their rims, and methods of using a provided toy finger ring for kids comprised of means for rotating and then subsequently releasing other gyroscopic toy apparatuses or objects, such as spinning tops, flying propellers, or wheels that roll on their rims for fun and enjoyment.

Description of the Prior Art

There are many types of launching or starting apparatuses used to start gyroscopic tops, flying propellers, or wheels so they spin very fast about a central axis, but there are no finger rings commercially available that are comprised of means for launching or starting gyroscopic tops, flying propellers, or rolling wheels so they spin very fast around a central axis. There are also no known commercial methods of using a ring meant for wearing on a human finger that's comprised of means for launching or starting a gyroscopic top, flying propeller, or rolling wheel so they spin very fast around a central axis in order to provide fun and amusement to onlookers and users.

It would then be of great benefit and is thus an object of the present invention to provide a toy ring-launcher apparatus for wearing on a human finger comprised of means for rotating and then subsequently releasing gyroscopic spinning tops, flying propellers, or rolling wheels so they are rotated, released, and then move separately on a flat surface, in the air, or on a toy racing track, respectively. For clarification, the words "launching" or "launcher" refer to the act of rotating and then subsequently releasing a spinning top so it spins independently on its own and free of the launcher or launching apparatus. And the word "ring" as used herein refers to an item of jewelry or any apparatus that can be worn on a human finger. It would also be of great benefit and is thus another object of the present invention to provide a method comprised of first providing a finger wearable toy ring-launcher apparatus comprised of means for rotating and then subsequently releasing gyroscopic spinning tops, flying propellers, or rolling wheels (for instance that look similarly to a very small automobile tire mounted on a rim), and then using the provided toy ring-launcher apparatus for having fun and enjoyment.

SUMMARY OF THE INVENTION

In view of the foregoing design considerations and limitations of apparatuses for causing other toy apparatuses with gyroscopic tendencies to rotate around a central axis, the present invention provides a toy ring-launcher apparatus for wearing on a human finger as an item of play jewelry that's comprised of means for causing to rotate and then subsequently releasing other toy apparatuses exhibiting gyroscopic tendencies, such as gyroscopic tops, flying propellers, or rolling wheels, so they rotate very fast around a central axis and move independently on a flat surface, in the air, or on a toy racing track, respectively. Also provided are methods comprised of first providing and then using a toy ring-launcher apparatus that's worn on a human finger and comprised of means for rotating and then subsequently releasing various toy apparatuses exhibiting gyroscopic tendencies, such as gyroscopic tops, flying propellers, or rolling wheels so they rotate around a central axis and move freely on a flat surface, in the air, or on a toy racing track, respectively, for the purpose of providing fun and enjoyment to onlookers and users.

DESCRIPTION

A primary embodiment of the present invention is a novel toy ring-launcher apparatus that is worn on a human finger as an item of play jewelry which is comprised of means for rotating (same meaning as "causing to rotate"), and then subsequently releasing (same process as "launching while rotating" or "ejecting while rotating") other toy apparatuses that exhibit gyroscopic tendencies, such as gyroscopic spinning tops, flying propellers, or rolling wheels so they rotate very fast around a central axis. More specifically, the means for rotating and then subsequently releasing other toy apparatuses exhibiting gyroscopic tendencies comprising the toy ring-launcher apparatus known as a primary embodiment of the present invention is comprised of a retractable string launching-apparatus, also known simply as a string-launcher, and which is further comprised of a spool that holds a length of string, a spiral torsion spring that resists spinning of the spool on its central axis, a rotary table or spindle that's rigidly attached to the spool, prongs or other means for holding and then subsequently releasing various spinning gyroscopic toy apparatuses, an upper housing, and a lower housing. The lower housing is comprised of a fully closed or partially open ring or other means for temporarily attaching the lower housing to a human finger that projects downward or away from the bottom surface of the lower housing. In other words, the lower housing is comprised of a finger ring that can be worn on a human finger.

A second embodiment of the present invention is a method comprised of first providing a toy ring-launcher apparatus capable of being worn on a human finger as an item of play jewelry comprised of means for rotating and then subsequently releasing other toy apparatuses exhibiting gyroscopic tendencies, such gyroscopic spinning tops, flying propellers, or rolling wheels to spin very fast on a central axis, and then wearing and using the provided toy ring-launcher apparatus to have fun and enjoyment by rotating and then subsequently releasing other gyroscopic toy apparatuses, such as gyroscopic toy tops, flying propellers, or rolling wheels as they move independently and rotate very fast around a central axis.

DRAWINGS

Numeral Assignment

1—Spool
2—Lower Housing
3—Ring
4—Central Hub
5—String
6—Spiral Torsion Spring
7—Rotary Table or Spindle
8—Prong
9—Gyroscopic Toy Top
10—Flying Propeller
11—Rolling Wheel On A Hub
12—Upper Housing

GENERAL DESCRIPTION OF THE DRAWING FIGURES

FIG. 1 shows an exploded view showing the internal components of a novel toy ring-launcher apparatus capable of being worn on a human finger and comprised of means for means for rotating and then subsequently releasing various apparatuses exhibiting gyroscopic tendencies to spin very fast about a central axis, which is further comprised of a string-launcher apparatus.

Figure 2:
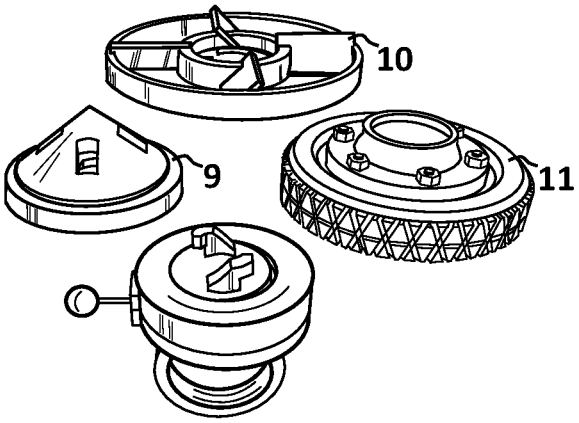

FIG. 2 shows a toy ring-launcher apparatus comprised of means for rotating and then subsequently releasing gyroscopic apparatuses to spin very fast around a central axis, and three other gyroscopic toy apparatuses, which are a gyroscopic toy top, flying propeller, and rolling wheel that can be started, launched or rotated by the string-launcher comprising the means for rotating and then subsequently releasing gyroscopic apparatuses which also comprises the toy ring-launcher apparatus known as the present invention that can be worn on a human finger as an item of play jewelry.

Figure 3:
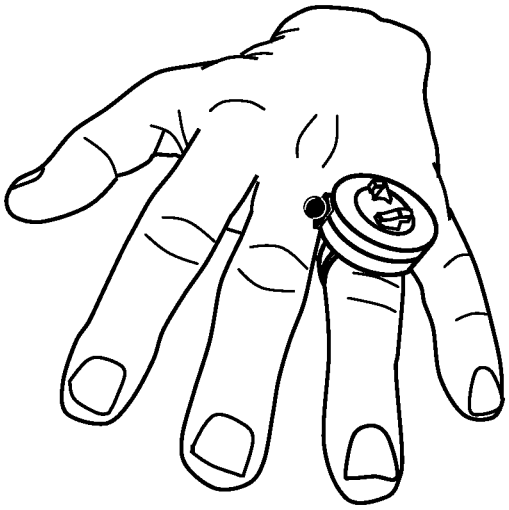

FIG. 3 shows an embodiment of the present invention which is a toy ring-launcher apparatus comprised of means for rotating and then subsequently releasing various gyroscopic toy apparatuses to spin very fast around a central axis while the toy ring-launcher apparatus is actually being worn as an item of play jewelry on a human finger and before another gyroscopic toy apparatus, such as either a gyroscopic spinning top, a flying propeller, or a rolling wheel is mounted on the prongs comprising the rotary table of the depicted toy ring-launcher apparatus.

DETAILED DESCRIPTION OF THE DRAWING FIGURES

FIG. 1 shows an exploded view of the components comprising a preferred embodiment of the present invention which is a novel toy ring-launcher apparatus capable of being worn on or attached to a human finger as an item of play jewelry and which is comprised of means for rotating and then subsequently releasing a gyroscopic top, flying propeller, or a rolling wheel to rotate very fast around a central axis, and which is comprised of a string-launcher apparatus that's further comprised of a spiral torsion spring 6, a spool 1, a length of string 5, a rotary table 7 comprised of prongs 8 or hooks, an upper housing 12 and a lower housing 2 that's comprised of a fully closed or partially open ring 3 or other means for temporarily attaching the lower housing 2 to a human finger. The spool's central hole fits around a stationary central hub 4 that's rigidly attached to floor and projects upward from the center of the lower housing 2, and the spool 1 can freely rotate about the central hub 4. A length of string 5 is wound around the spool 1 with one end of the string 5 protruding outward as shown and having a knob at the distal end. The opposite end of the string is permanently attached to the spool 1. A spiral torsion spring 6 rests inside the spool 1. One end of the spiral torsion spring 6 is rigidly attached to the stationary central hub 4 of the lower housing 2 and the other end is rigidly attached to the spool 1. That implies when the spool 1 is spun in a certain direction about the central hub 4, it will wind the spiral torsion spring 5 in such a way that the spiral torsion spring 6 will attempt to bring the spool 1 back to its original rotational starting position with a great amount of torque. That also implies if the end of the string 5 is pulled outward as shown, it will unwind the string from around the spool while spinning the spool in a certain direction that stresses and adds energy to the spiral torsion spring which then tries to bring the spool back to its rotational starting point. So as the string unwinds from the spool when its end is pulled outward and away from the spool, it will wind the spiral torsion spring ever tighter with great force. And when the end of the string is released, the spiral torsion spring will unwind or spring back in the opposite direction with a great amount of torque to turn the spool in the opposite direction and rewind the string onto the spool. As the torsion spring unwinds, the string will rewind onto the spool as the spool moves to the starting position o the next launching cycle can begin. Now, the rotary table 7 is permanently attached to the spool 1, which acts as a spindle to hold the rotary table so it always spins in concert and coordination with the spool 1. The rotary table 7 is comprised of prongs 8, hooks, or other means for holding and subsequently releasing various gyroscopic toy apparatuses, such as a gyroscopic top 9, a flying propeller 10, or a rolling wheel 11 as shown in FIG. 2. The prongs 8 or hooks for instance would fit into holes or slots cut into the bottom surfaces of gyroscopic spinning tops 9, flying propellers 10, or rolling wheels 11 and hook them to hold them in place as the string 5 is pulled outward and away from the spool 1 in order to tightly wind the spiral torsion spring. Then when the end of the string 5 is released, the spool 1 and attached rotary table 7 will spin rapidly in the opposite direction to also spin and eventually release the mounted gyroscopic top 9, flying propeller 10, or rolling wheel on a hub 11 so it spins independently of the rotary table 7. The prongs 8 are designed with a rear curved or tapered surface so as the spool and attached rotary table stop very abruptly, momentum gained by the mounted gyroscopic spinning top, flying propeller, or rolling wheel cause it to continue spinning. At that point, the rear ends of the prong mounting holes of the gyroscopic top, flying propeller, or rolling wheel will ride along the curved or tapered surface of the prongs and thus eject it from the ends of the prongs so it moves completely free of the rotary table. The rotary table 7 projects through the top housing section 12 and provides a relatively smooth and flat surface for mounting objects, such as a gyroscopic top, flying propeller, or a rolling wheel.

It's important to note that any method of using a provided toy ring string-launcher apparatus known as the present invention as it's worn on a human finger to launch a gyroscopic top, a flying propeller, or a rolling wheel for the purpose of having fun or excitement as described herein would be known by one skilled in the art to be another embodiment of the present invention.

FIG. 2 again shows a gyroscopic toy top, a flying propeller, and a rolling wheel, and how they would mount onto the prongs 8 of rotary table 7 of the ring string-launcher now known to be a primary embodiment of the present invention. Note that the wearer and user of the toy ring apparatus known as a primary embodiment of the present invention would be directed or instructed to aim the provided ring string-launcher known as a primary embodiment of the present invention so its rotary table is pointed generally downward toward the ground when launching a gyroscopic spinning top, or else to hold or aim the provided ring string-launcher so its rotary table is generally pointed upward toward the sky when launching a flying propeller, or else to hold or aim the provided ring string-launcher's rotary table so its rotary table is pointed generally sideways or perpendicular to the ground when launching a rolling wheel so the wheel spins on its outer rim.

FIG. 3 shows the provided ring string-launcher as it's worn on a human finger as an item of play jewelry and before a gyroscopic top, a flying propeller, or a rolling wheel is mounted on its rotary table for launching. The finger is essentially slipped through the ring 3 comprising the lower housing 2. One such method of using the ring string-launcher as shown would comprise first providing the toy ring-launcher apparatus that can be worn on a human finger and comprised of means for rotating and then subsequently releasing other toy apparatuses to spin around a central axis, then placing the provided ring string-launcher apparatus on a human finger, then mounting or attaching another gyroscopic toy apparatus, such as a gyroscopic spinning top, a flying propeller, or a rolling wheel onto the prongs comprising the rotary table, then pulling a length of string outward and away from the provided launcher in order to rotate the spool and place stress on the spiral torsion spring, then releasing the length of string so it moves back toward the provided launcher and into the housing very rapidly which drives the rotary table in a manner that also rotates the prongs with the attached gyroscopic toy top, flying propeller, or rolling wheel very rapidly while ejecting it off and away from the prongs comprising the rotary table. Note that the toy ring-launcher apparatus known as the present invention does not necessarily have to be worn on a human finger to rotate and then subsequently release other toy apparatuses that exhibit gyroscopic tendencies, but it's generally intended for that particular purpose.

Additional Embodiments

It's conceivable that the means for rotating and then subsequently releasing other toy gyroscopic apparatuses or objects, such as gyroscopic spinning tops, flying propellers, or rolling wheels that comprises the toy ring apparatus known to be the present invention can be comprised of components distinctly different from those comprising the aforementioned string-launcher apparatus. For instance, the means for rotating and then subsequently releasing other toy apparatuses, such as gyroscopic toy tops, flying propellers, or rolling wheels that comprises the toy ring-launcher apparatus known as the present invention can be of the wind-up spring launcher type that operates by loading or winding a coil spring that comprises the toy ring-launcher apparatus very tightly, and then releasing the loaded spring to spin a mounted gyroscopic toy apparatus by pressing a button mounted somewhere on the toy ring-launcher apparatus. The means for rotating and then subsequently releasing other gyroscopic toy apparatuses, such as gyroscopic spinning tops, flying propellers, or rolling wheels that comprises the toy ring-launcher apparatus can also be of the rip-cord launcher apparatus type that in turn would be comprised of a gear having teeth that can engage with the teeth on a separate rip-cord apparatus when the separate rip-cord apparatus is pulled or ripped or raked across the teeth of the gear comprising the toy ring-launcher apparatus. However, a wearable toy ring-launcher apparatus comprised of any means for rotating and then subsequently releasing other toy apparatuses such as gyroscopic tops, flying propellers, or rolling wheels to rotate very fast while the toy ring-launcher apparatus is being worn on a human finger, would be recognized by one skilled in the art to be another embodiment of the present invention. Moreover, any method comprised of first providing a toy ring-launcher apparatus known to be the present invention that can be worn on a human finger and which is further comprised of means for rotating and then subsequently releasing a gyroscopic spinning top, a flying propeller, or a rolling wheel, and then using that provided toy ring-launcher apparatus to have fun and enjoyment, would be known by one skilled in the art to be another embodiment of the present invention. There are many different possible designs of half-tapered protrusions including prongs, hooks, or tines of any sort that are added to or which can comprise the rotary table in order to temporarily hold and then later release a rapidly spinning gyroscopic top, flying propeller, or rolling wheel, whether each of those toys has matching holes or slots to receive the prongs or not. It is also conceivable that the rotary table can be comprised of other structures or physical compositions that will allow edible or non-edible round or oval objects, such as jelly beans, chocolate eggs, other relatively hard candies, or even hard-boiled eggs to be rotated and then subsequently released by or with the toy ring-launcher apparatus known as the present invention. For that matter, a string-launcher as described herein that comprises the toy ring-launcher apparatus capable of launching the round or oval objects just mentioned does not necessarily have to comprise a ring that is worn on a human finger. Instead, it can have a simple handle that can be grabbed with two fingers comprising the lower housing. The finger ring apparatus that comprises the lower housing section and which temporarily holds the ring string-launcher known as the present invention on a human finger can be made as a fully closed or partially open band, ring, or other suitable shape that allows it to be firmly, but temporarily attached to a human finger. It can also be made of any material or matter whether it's elastic, such as a rubber-band that stretches, or whether it's rigid plastic or metal. Various other gyroscopic toy apparatuses, such as gyroscopic spinning tops, flying propellers, or rolling wheels that are launched from the toy ring-launcher apparatus now known to be a primary embodiment of the present invention as well as the toy ring-launcher apparatus itself, can be comprised of electrochemical batteries, an electric generator, lights, or sound-producing means or apparatuses to make them more playful, useful, or exciting to watch. They can also be made in the shapes of, have notable impressions made on them, or be colored in a manner that signifies a cartoon character, a popular superhero action figure, or any other depiction of a well known character or object. Lastly, any method that comprises first providing a wearable toy ring-launcher apparatus comprised of means for rotating and then subsequently releasing other gyroscopic toy apparatuses or objects, such as gyroscopic tops, flying propellers, or rolling wheels to rotate very fast around a central axis, and then which directs or instructs a wearer of the toy ring-launcher apparatus to use or employ the provided toy ring-launcher apparatus in any way for having fun will indeed be known by one skilled in the art to be another embodiment of the present invention. Although the description above contains many specificities, these should not be construed as limiting the scope of the invention but as merely providing illustrations of some of the presently preferred embodiments of this invention. Thus, the scope of the invention should be determined by any appended claims and their legal equivalents, rather than by any examples given.

What is claimed is:

1. A toy ring-launcher apparatus worn on a human finger as an item of play jewelry comprising a launching apparatus of the type comprising a length of string and a spool for holding said length of string for launching gyroscopic spinning tops, or flying propellers, or rolling wheels after unwound and extended said length of string rewinds onto said spool and after said spool abruptly stops rotating, whereby said gyroscopic spinning tops, or flying propellers, or rolling wheels are launched with minimum effort from said human finger without causing physical harm or injury to said human finger.

2. The toy ring-launcher apparatus of claim 1 wherein said launching apparatus launches said spinning top, said flying propeller, or said rolling wheel only after unwound and extended said length of string rewinds onto said spool so the physical size of said launching apparatus is reduced for wearing on small said human finger and for preventing injury or discomfort to said small human finger.

3. The toy ring-launcher apparatus of claim 1 wherein said launching apparatus comprises a rip-cord launcher apparatus sized to fit for wearing on small said human finger without causing harm or discomfort to said small human finger.

4. The toy ring-launcher apparatus of claim 1 wherein said launching apparatus comprises a wind-up spring launcher apparatus of the type comprising a spiral torsion spring and sized to fit for wearing on small said human finger without causing harm or discomfort to said small human finger.

5. A toy ring and string-launcher apparatus worn on a human finger as an item of play jewelry, comprising:

(a) a spiral torsion spring, (b) a length of string with a knob attached to one end, and (c) a spool for holding said length of string, and (d) an upper housing, and (e) a rotary table comprised of prongs or hooks, and (f) a lower housing comprised of an open or closed ring for temporarily attaching said lower housing to a human finger, and purposed for rotating and launching a spinning top, or a flying propeller, or a rolling wheel mounted on said prongs after releasing said knob, and after unwound and extended said length of string rewinds onto said spool, whereby said gyroscopic spinning tops, or flying propellers, or rolling wheels are launched safely from said human finger with minimum effort.

6. A method for launching a gyroscopic spinning top, a flying propeller, or a rolling wheel using a toy ring and string-launcher apparatus, comprising:

(a) providing said toy ring and string-launcher apparatus of the type comprising a spiral torsion spring, a length of string with a knob attached to one end, a spool for holding said length of string, a rotary table with a set of attached prongs, an upper housing, and a lower housing with an attached open or closed ring, (b) wearing provided said toy ring and string-launcher apparatus on a human finger, (c) mounting said gyroscopic spinning top, or said flying propeller, or said rolling wheel, onto said prongs, (d) pulling said knob attached to one end of said string slowly and steadily away from said lower housing for rotating said rotary table in one direction to tighten and store energy in said spiral torsion string, (e) holding said knob stationary temporarily for aiming said rotary table, (f) releasing said knob so said spiral torsion spring rapidly unwinds to rotate said rotary table and attached said prongs in opposite said direction as said string rewinds onto said spool, (g) allowing said rotary table to stop abruptly for ejecting and launching mounted said gyroscopic spinning top, or said flying propeller, or said rolling wheel from said prongs, whereby said gyroscopic spinning top, or said flying propeller, or said rolling wheel is launched from said human finger only with energy stored by tightening said spiral torsion spring.

* * * * *